United States Patent [19]

Park et al.

[11] Patent Number: 4,769,094

[45] Date of Patent: Sep. 6, 1988

[54] AMORPHOUS-NICKEL-BASE ALLOY ELECTRICAL RESISTORS

[75] Inventors: Tae S. Park, Suwon; Dong H. Ahn, Seoul, both of Rep. of Korea

[73] Assignee: Samsung Electronics Co., Ltd., Suwon, Rep. of Korea

[21] Appl. No.: 802,158

[22] Filed: Nov. 25, 1985

[30] Foreign Application Priority Data

Nov. 26, 1984 [KR] Rep. of Korea ..... 1984-7398

[51] Int. Cl.[4] ..... C22C 19/05

[52] U.S. Cl. ..... 148/403; 148/427; 338/321; 338/334; 420/442

[58] Field of Search ..... 148/403, 427; 420/442; 338/321, 333, 334

[56] References Cited

U.S. PATENT DOCUMENTS 4,283,225 8/1981 Sexton et al. ..... 148/403

4,543,135 9/1985 Bose et al. ..... 148/403

*Primary Examiner*—R. Dean

*Attorney, Agent, or Firm*—Oblon, Fisher, Spivak, McClelland & Maier

[57] ABSTRACT

Amorphous Nickel-base alloys for electrical resistors, which contain, by atomic %, 81−x% Ni, x% Cr, 6% B and 13% Si (z=0∼25), or 70% Ni, 11% Cr, 19−y% B and y% Si (y=0∼19 except 13), or 100−z% of 0.864 Ni and 0.136 Cr and z% of 0.316 B and 0.684 Si (x=15∼25 except 19), and have a relatively high electrical resistivity and a small temperature coefficient of resistivity, are disclosed. Their resistance values can be adjusted by heat treatment and the thermal stability of them after heat treatment is very good in the conventional operating temperature range of electrical components.

7 Claims, 2 Drawing Sheets

AMORPHOUS-NICKEL-BASE ALLOY ELECTRICAL RESISTORS

BACKGROUND OF THE INVENTION

The present invention relates to amorphous Nickel alloys for electrical resistor and particularly Ni—Cr—B—Si alloys in amorphous or partially crystalline state which has a relatively high electrical resistivity and a small temperature coefficient of resistivity.

Metallic materials with a relatively high and temperature-independent resistivity are of great interest for the production of high quality resistors. The metallic materials in amorphous state have a relatively high electrical resistivity and a small temperature coefficient of resistivity (hereinafter referred as TCR) and the metallic materials in amorphous state are crystallized through heat treatment.

In order to use an amorphous materials for practical resistors, this amorphous material should have temperature-independent resistivity before and after crystallization, a relatively large change in the resistivity at the crystallization temperature (hereinafter referred as Tcr) and possibly high Tcr (e.g., ~450° C.).

A nearly zero TCR has been found in the amorphous Ni—B—Si alloys by adjusting metalloid concentration (K. Fukamichi, H. M. Kimura, T. Masumoto; Journal of Applied Physics 52, 2872, 1981).

Unfortunately, in these alloys and other amorphous alloys having extremely small TCR, known in the literature, the temperature dependence of resistivity after crystallization shows generally large positive TCR. Hence, these alloys are not suitable for heat treatment.

The object of this invention is to provide metallic materials in amorphous state which have a relatively high and temperature-independent electrical resistivity in the conventional operating temperature (−50°~150° C.) of electrieal components, i.e., amorphous materials of a very small TCR.

Another object of this invention is to provide a resistance adjustment process through heat treatment (hereinafter called as thermal trimming) of the alloys. So far, the resistance value of the resistor with crystalline materials has been adjusted or trimmed by means of geometrical changing technology, e.g., surface polishing, anodic oxidation or laser beam cutting after they are manufactured with a tolerance value of ±5% and separate resistance adjustment for each and every resistor should have been made.

DETAILED DESCRIPTION OF THE INVENTION

Figure 1:
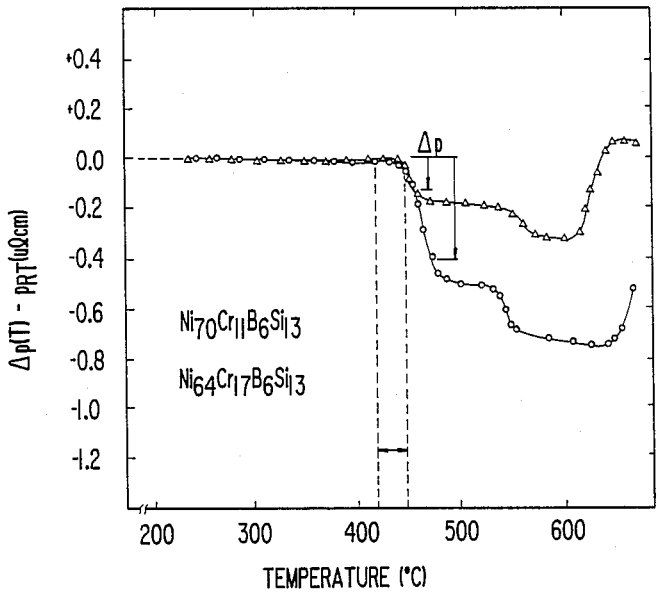
FIG. 1 shows the relation between the temperature and the resistivity of the alloys prepared through melt-spinning by rapid quenching method according to the present invention.

The present invention will be described in detail according to the accompanying drawings.

There are several amorphous alloy systems suitable for the purpose of this invention, e.g., Pd—Si, Cu—Zr, or Ni—B—Si based glasses. The former two alloy systems were not chosen, because Pd is expensive and Zr is very sensitive to oxidation as is known. Therefore, a Ni-based amorphous alloy containing Boron, Silicon and Chrome was chosen as base alloy for the present invention.

Materials in the amorphous state may be regarded as "frozen liquids" and obtaining an amorphous state is to retain in the solid the atomic arrangement present in the liquid.

The compositions of the alloys according to the present invention are as follows (the unit is atomic percent);

(1) $Ni_{81-x}Cr_xB_6Si_{13}$ (x=0~25)

(2) $Ni_{70}Cr_{11}B_{19-y}Si_y$ (y=0~19 except 13), and (3) $(Ni_{0.864}Cr_{0.136})_{100-z}(B_{0.316}Si_{0.684})_z$ (z=15~25 except 19).

The purity and the form of starting elements used for this invention are listed in table 1.

TABLE 1

The purity and the form of the elements

| Elements | Purity (%) | Form |
|---|---|---|
| Ni | 99.840 | powder |
| Cr | 99.999 | granule |
| B | 99.000 | granule |
| Si | 99.999 | granule |

Several methods have been adopted to obtain the alloys of this invention and some are introduced below.

The First Embodiment

The specimens, weighed in air by an analysis balance with an accuracy of $10^{-5}$ g (Mettler H15), were mixed thoroughly with the varying compositions as the above and then pressed with the pressure of 4 Tons/cm$^2$ as a rod of 12 mm in diameter.

This rod was fully melted in an electric arc furnace under argon atmosphere. The molten jet was ejected onto the outer surface of a rapidly rotating disk through the orifice by helium gas pressure and flattened into a ribbon form with the high cooling rate (Rapidly Quenched Metals, III, Vol. 1, The Metal Society, 1978).

The speed of the disk rotation was varied in the range $3\sim7\times10^3$ rev/min, corresponding to surface velocities of the disk of 18~43 m/sec.

The resulting ribbons were continuous, relatively uniform in dimensions and 15 to 50 μm thick. The ribbon width was generally about 2~3 times the orifice diameter for a circular form, whereas, for rectangular orifice, the ribbon width was determined by the nozzle orifice length.

In order to control the ribbon dimensions, the ejection gas pressure, F, the surface velocity of the substrate, $v_d$, and the distance between the orifice and the substrate surface, y, have been varied. The resulting ribbon dimensions are listed in Table 2.

It is seen that at a constant speed of the substrate, the distance y has a minor influence on both the ribbon thickness and width, but the ejection gas pressure has an influence on the ribbon width. At constant ejecting gas pressure, F, neglecting the influence of distance y and if the velocity of the molten jet until fully solidified is taken equal to the surface velocity of the disk, the cross-sectional area of the ribbon, $A_r$, can be written as, $$A_r = \frac{2F}{v_d^2 c},$$

where c is the density of the liquid.

TABLE 2

| Resulting ribbon width(w) and thickness(t) | | | |
|---|---|---|---|
| Conditions | F(mbar) | t(μm) | w(mm) |
| $\phi$ = 0.5 mm, y = 1.9 mm | 0.27 | 22~23 | 1.2 |
| v = 37 m/s | 0.34 | 25~26 | 1.4 |
| for Ni—Cr—B—Si alloys | 0.40 | 29~31 | 1.6 |
| $\phi$ = 0.5 mm, v = 31 m/s | | | |
| for $Fe_{40}Ni_{40}B_{20}$ alloys(as comparison) | | | |
| (a) y = 0.65 mm | 0.27 | 35 | 1.15 |
| | 0.53 | 32 | 1.3 |
| | 0.80 | 35 | 1.45 |
| (b) y = 1.3 mm | 0.27 | 31 | 1.2 |
| | 0.53 | 32 | 1.3 |
| | 0.80 | 31 | 1.35 |
| (c) y = 1.9 mm | 0.27 | 34 | 1.2 |
| | 0.53 | 30 | 1.3 |
| | 0.80 | 32 | 1.45 |
| (d) y = 2.2 mm | 0.27 | 31 | 1.3 |
| | 0.53 | 28 | 1.5 |
| | 0.80 | 30 | 1.55 |

| F = 0.4 mbar | Orifice: width × length | | | | | |
|---|---|---|---|---|---|---|
| v = 31 m/s | 0.13 × 3 mm | | 0.15 × 4 mm | | 0.15 × 14 mm | |
| For $Fe_{40}Ni_{40}B_{20}$ alloys | t(μm) | w(mm) | t(μm) | w(mm) | t(μm) | w(mm) |
| y = 0.1 mm | 31 | 2.75 | 31 | 4.1 | 31 | 14 |
| y = 1.3 mm | 29 | 1.9 | | | | |

From Table 2, it is found that the ribbon width can be controlled via the ejection gas pressure for circular orifice, or the orifice length of the rectangular orifice, and the ribbon thickness can be controlled via the surface velocity of the disk.

The above method can be called rapid quenching by melt-spinning method.

The Second Embodiment

Amorphous alloys can also be prepared by D.C. sputtering method under conditions of both low substrate temperature and high sputtering rate as taught in Handbook of Thin Film Techonology by L. I. Maisel and R. Glang (McGraw-Hill, New York, 1970). In order to achieve these conditions, a d.c. sputtering apparatus was designed so that the substrate can be cooled by water or liquid nitrogen.

To measure the substrate temperature during sputtering a platinum resistor(Pt 100) was placed directly under the substrate. As substrate, micro-slide glasses of 1 mm thickness were taken. The sputtering bell-jar was initially evacuated to about $8\sim13\times10^{-6}$ mbar and then argon gas was introduced in the range of $\sim3\sim7\times10^{-2}$ mbar. The d.c. sputtering voltage was varied in the range of 2.6~3.4 KV, and the distance between target and substrate was kept at about 2~2.8 cm. The specimens (about 200 g) with the composition of $Ni_{70}Cr_{11}B_6Si_{13}$ and $Ni_{64}Cr_{17}B_6Si_{13}$ respectively were melted by middle frequency induction heating in a graphite crucible under argon atmosphere. The above alloys were sputtered with a rate of approximately ~0.13 μm/min onto the glass substrate. Some runs with water-cooled substrate holder, but without any heat transfer medium between the substrate and the substrate holder, resulted in microcrystalline samples, the substrate temperature being up to about 350° C. Hence, later runs were made using a silicon-based vacuum grease as a heat transfer medium between substrate and the water cooled substrate holder. The substrate temperature during sputtering for 15~120 minutes did not exceed about 30° C.

The Third Embodiment

An alloy of $Ni_{64}Cr_{17}Si_{19}$ was prepared by the same method as the second embodiment as Boron and Silicon do the similar role in the alloy of the present invention.

From the examinations of the First Embodiment alloys by Guinier X-ray diffraction, most of the ribbons prepared were found to be amorphous except the following alloys;

(1) $Ni_{81-x}Cr_xB_6Si_{13}$ alloys with $x\leqq3$ and $x\geqq25$,
(2) $Ni_{70}Cr_{11}B_{19-y}Si_y$ alloys with $y=0$ and $y\geqq17$, and
(3) $(Ni_{0.864}Cr_{0.136})_{100-z}(B_{0.316}Si_{0.684})_z$ alloys with $z\leqq17$ and $z\geqq25$, which were partially crystalline.

For D.C. sputtered films, the ones containing Boron were found to be partially crystalline from the examination by X-ray diffraction, while the ones without Boron were amorphous.

Table 3 shows the resistivity data measured for the alloys of the present invention.

The room temperature resistivities, ρRT, obtained from the present alloys were relatively high and had values between ~90–190 μΩcm. It was found that the crystallization temperatures, Tcr, for all the samples were relatively high and the changes in the resistivity at the crystallization temperature were about 2–17%.

TABLE 3

| Results of the resistivity measurements | | | | |
|---|---|---|---|---|
| x (at. %) | ρRT (μΩcm) | TCR ($10^{-6}K^{-1}$) | $T_{cr}$(K) | $\frac{\Delta\rho}{\rho RT}\Big\vert_{T_{cr}}$ (%) |
| x = 3 | | crystalline phase | | |
| 5 | 141 | −4.05 | 658 | 3.28 |
| 7 | 143 | −20.50 | 703 | 1.58 |
| 9 | 151 | −21.10 | 705 | 2.80 |
| 11 | 185 | −16.04 | 709 | 5.30 |
| 13 | 182 | −14.90 | 711 | 7.80 |
| 15 | 175 | −15.60 | 723 | 10.00 |
| 17 | 169 | −14.83 | 725 | 11.01 |
| 19 | 166 | −14.15 | 728 | 13.20 |
| 21 | 164 | −10.95 | 743 | 14.70 |
| 23 | 163 | −13.24 | 743 | 14.70 |
| 25 | | crystalline phase | | |
| y (at. %) | ρRT (μΩcm) | TCR ($10^{-6}K^{-1}$) | $T_{cr}$(K) | $\frac{\Delta\rho}{\rho RT}\Big\vert_{T_{cr}}$ (%) |
| y = 0 | | crystalline phase | | |
| 1 | 161 | −4.74 | 680 | 3.88 |
| 2 | 173 | −1.03 | 685 | 4.80 |
| 3 | 155 | −3.04 | 686 | 4.80 |
| 4 | 154 | −2.05 | 693 | 4.00 |
| 5 | 152 | −2.14 | 692 | 4.00 |
| 6 | 146 | −0.86 | 690 | 3.90 |
| 7 | 141 | −7.97 | 693 | 3.80 |
| 8 | 148 | −0.87 | 695 | 3.90 |
| 9 | 153 | −6.63 | 698 | 3.90 |
| 10 | 160 | −8.64 | 703 | 3.90 |
| 11 | 165 | −5.50 | 705 | 3.20 |
| 12 | 169 | −7.47 | 708 | 1.80 |
| 14 | 196 | −17.80 | 712 | 6.60 |
| 15 | 166 | −13.40 | 715 | 10.00 |
| 16 | 160 | −3.07 | 716 | 3.07 |
| 17 | | crystalline phase | | |
| z (at. %) | ρRT (μΩcm) | TCR ($10^{-6}K^{-1}$) | $T_{cr}$(K) | $\frac{\Delta\rho}{\rho RT}\Big\vert_{T_{cr}}$ (%) |
| z = 17 | | crystalline phase | | |
| 21 | 195 | −21.40 | 721 | 7.57 |
| 23 | 213 | −23.89 | 721 | 17.47 |
| 25 | | crystalline phase | | |

Now, the possibility of applying the present alloys for ohmic resistor is examined.

An amorphous material, suitable for the application of thermal trimming, should have following properties. The resistivity should be possibly high in order to obtain a high sheet reslstance value, especially if this amorphous material is used in microelectronic circuits, e.g., in an integrated circuit (IC). The electrical resistivity should be temperature-independent before and after crystallization in the conventional operating temperature range (e.g., $-50° \sim 150°$ C.) of electrical components.

The relative change in the resistivity, $\Delta\rho$, at the crystallization temperature, Tcr, should possibly be large in order to adjust any desired resistance value within the fabrication tolerance (e.g., roughly $\pm 5\%$ as taught in Basic Integrated Circuit Engineering by D. J. Hamilton and W. G. Haward (McGraw-Hill, New York, 1975).

Furthermore, Tcr should lie as high as about 450° C., because various heat treatments are required in the fabrication processes of microelectronic circuits, e.g., sintering for ohmic contact or aluminium adhesion. This sintering is usually carried out at temperatures approximately $420° \sim 450°$ C. for $10 \sim 20$ minutes. Therefore if Tcr lies at about this temperature, the crystallization process can be controlled via holding temperature (slightly below Tcr) and time, and thus the sintering process can be used for the thermal trimming of resistance. Hence, an extra processing step for any desired tolerance value is not necessary. It is noted that there are other heat treatments in the fabrication processes of microelectronic circuits, e.g., the die attachment, encapsulation or high stress test after assembly via temperature. These heat treatment can be carried out at relatively low temperature.

From the results of the systematic investigation of the electrical resistivity in the present invention, the amorphous Ni—Cr—B—Si alloy system was chosen as practically applicable material for thermally trimmed electrical resistors, because this alloy system seems to nearly satisfy all the above described requirements (e.g., extremely small TCR and relatively high Tcr).

Amorphous Ni—Cr—B—Si alloy systems with the compositions of the present invention have been systematically investigated to obtain more suitable material for thermally trimmed electrical resistors.

FIG. 1 shows typical behavior of the electrical resistivity as a function of temperature (above room temperature), $\rho(T)$, for the samples of the present invention with the compositions $Ni_{70}Cr_{11}B_6Si_{13}$ and $Ni_{64}Cr_{17}B_6Si_{13}$, prepared by rapid quenching method. All the samples studied showed relatively high resistivities and extremely small negative TCR, calculated from $\rho(T)$-curve in the temperature range $20° \sim 200°$ C., and also the crossover from negative to positive TCR at high temperature above 300° C. (The mark ↓ in FIG. 1 indicates adjustable range of resistivity).

When the alloys in the amorphous state are heated, the amorphous state changes into a crystalline state. The crystallization temperature, at which an amorphous material begins to crystallize, was measured by means of differential thermal analysis (DTA) using an average rate of heating of $\sim 10°$ C./min and also by means of electrical resistance versus temperature runs with roughly the same rate of heating as in DTA.

The temperature for crystallization was taken as the temperature at which an exothermic peak begins to appear in DTA curve, and, respectively, that at which an initial sharp change (usually drop) in the resistance versus temperature curve occurs.

In order to use the alloy of the present invention as practical ohmic resistor, the resistance value can simply be adjusted within a desired tolerance value by means of thermal trimming, not by means of geometrical changing technology as for the crystalline metallic material. The thermal trimming is to make use of the drastic change of the resistivity at the crystallization temperature as can be seen in FIG. 1.

The condition of thermal trimming of resistance for amorphous Ni—Cr—B—Si alloys may be deduced from FIG. 1. The thermal trimming can be carried out in the temperature range of slightly below Tcr (e.g., $420° \sim 450°$ C.), as indicated as the mark ⟷ in the graph. In this temperature range, the amorphous phase changes into a distinct crystalline phase. Amorphous alloy is simply heated up to slightly below Tcr, held at this temperature for a few minutes, and then cooled rapidly, e.g., with cooling rate larger than $\sim 20°$ C./min.

Figure 2:
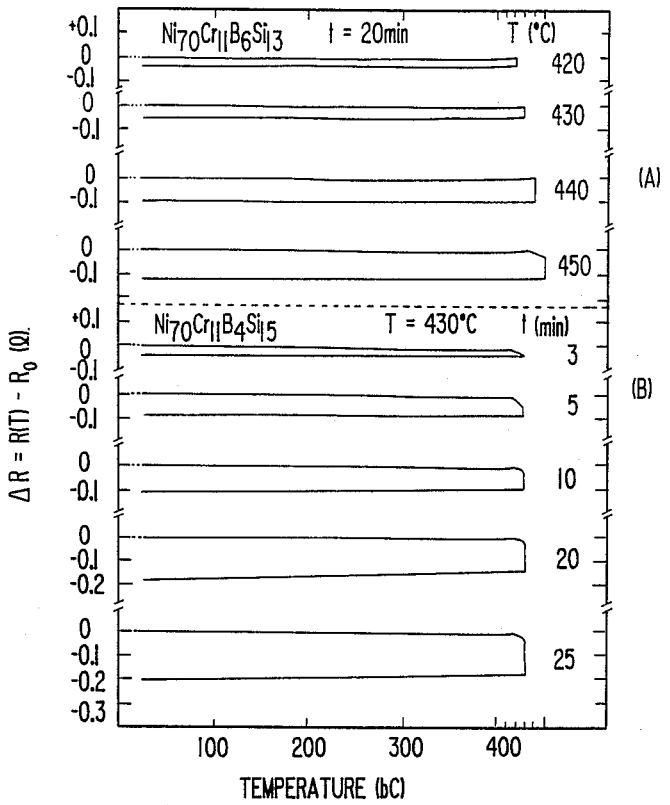
FIG. 2 shows typical thermal trimming processes for the alloys of the present invention.

As is seen in FIG. 2 in which $\Delta R$ indicates a changed portion of resistance value according to the thermal trimming, the resistance value depends on both holdlng time and temperature, i.e., on the degree of crystallization from amorphous state. FIG. 2(A) shows the thermal trimming process for the alloy of $Ni_{70}Cr_{11}B_6Si_{13}$ with the fixed holding time, i.e., 20 minutes after being heated up to different temperatures while FIG. 2(B) shows the process for the alloy of $Ni_{70}Cr_{11}B_6Si_{13}$ with the different holding times, i.e., 3, 5, 10, 20, and 25 minutes respectively after being heated up to the fixed temperature, i.e., 430° C.

The maximum adjustable range of resistance depends on the maximum change in resistivity at the first crystallization temperature, $\Delta\rho/\rho_{RT|Tcr}(\%)$, where $\rho RT$ is the resistivity at room temperature and $\Delta\rho$ is the changed value of resistance corresponding to the change of temperature, as listed in Table 3. Within this maximum change in the resistivity at Tcr, a desired resistance value can be adjusted by controlling the holding time and temperature.

After thermal trimming, the TCR, calculated from room temperature to 200° C., are listed in table 4, together with the resistance decrease, $\Delta R/R_o$ (%), at room temperature.

The TCRs for resistance decrease up to $\sim 6\%$ are extremely small positive or still small negative. As compared with crystalline metallic resistance materials, a relatively high resistivity and an extremely small TCR for the alloy of the present invention both in amorphous and partially crystalline states are found to be very useful for the production of high quality electrical resistors.

TABLE 4

| | Results of thermal trimming | | | |
|---|---|---|---|---|
| Composition | Holding time(min) | Holding temp.( °C.) | $\Delta R/R_o$ (%) | TCR ($10^{-6}$ $K^{-1}$) |
| $Ni_{70}Cr_{11}B_6Si_{13}$ | 20 | 420 | 1.5 | −8.55 |
| | " | 430 | 3.5 | −2.19 |
| | " | 440 | 4.7 | +5.83 |
| | " | 450 | 6.6 | +16.62 |
| $Ni_{64}Cr_{17}B_6Si_{13}$ | 20 | 420 | 1.0 | −17.13 |
| | " | 430 | 1.5 | −14.83 |
| | " | 440 | 5.5 | +11.28 |
| | " | 445 | 5.7 | +12.39 |
| | " | 450 | 13.2 | +253.83 |
| $Ni_{70}Cr_{11}B_4Si_{15}$ | 3 | 430 | 2.3 | −12.61 |
| | 5 | " | 4.7 | +7.23 |
| | 10 | " | 7.0 | +24.08 |
| | 20 | " | 9.7 | +42.17 |

TABLE 4-continued

| Composition | Results of thermal trimming Holding time(min) | Holding temp.( °C.) | $\Delta R/R_o$ (%) | TCR ($10^{-6}$ $K^{-1}$) |
|---|---|---|---|---|
| | 25 | " | 12.0 | +66.21 |
| $Ni_{70}Cr_{11}B_6Si_{13}$ | 25 | 440 | 2.4 | −2.43 |
| | 25 | 450 | 2.6 | −2.14 |
| | 25 | 460 | 4.0 | +65.84 |
| $Ni_{64}Cr_{17}Si_{19}$ | 3 | 320 | 13.2 | +6.71 |
| | 5 | 320 | 14.0 | +19.11 |
| | 10 | 320 | 21.4 | +26.28 |
| | 10 | 300 | 11.5 | +7.35 |
| | 10 | 250 | 10.3 | −1.09 |

For the D.C. sputtered alloys, the trimming process is the same as for the melt-spun ones, but Tcr of the D.C. sputtered $Ni_{64}Cr_{17}Si_{19}$ alloy is lower than that of Ni—Cr—B—Si alloys, the alloy was held at slightly lower temperature, i.e., 250°~320° C., as is seen in the end of table 4.

Figure 3:
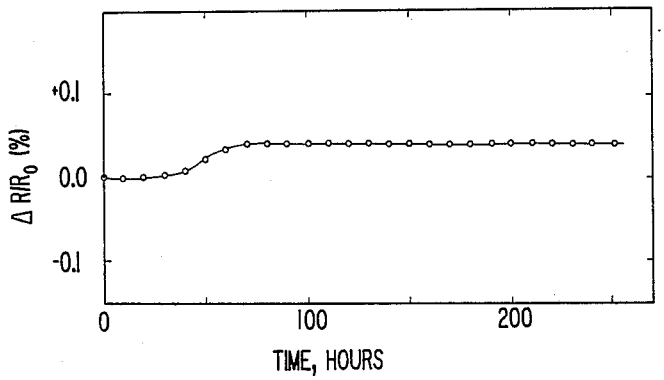
FIG. 3 shows resistance change versus time of annealing for thermally trimmed alloy of the present invention.

The thermal stability of the samples after thermal trimming was checked by means of isothermal electrical resistance measurements using standard four probe D.C. method in the temperature range 200°~300° C. for about 250 hours. In FIG. 3, an annealing behavior of thermally trimmed sample is shown.

The resistance value, after annealing at 250° C. for 250 hours, increases by less than ~0.05% from the room temperature resistance (Ro), showing that the thermal stability of the thermally trimmed alloy is very good at temperature below 250° C.

As can be seen from the above description, the alloys of this invention have very small temperature coefficients of resistivity and high electrical resistivities, and therefore, are suitable for electric resistors.

Especially, the resistance value can be simply adjusted by heat treatment, and the thermal stability after heat treatment is very good in the conventional operating temperature range of electrical components.

We claim:

1. An electrical resistor of high electrical resistivity and low temperature coefficient of resistivity, having a composition comprising an amorphous Ni—Cr—B—Si alloy consisting essentially of by atomic %, (a) 81−x % Ni, x % Cr, 6% B and 13% Si wherein x=0~25, or (b) 70% Ni, 11% Cr, 19−y % B and y % Si wherein y=0~19 except 13, or (c) 100−z % of 0.864 Ni and 0.136 Cr, and z % of 0.316 B and 0.684 Si wherein z=15~25 except 19.

2. The electrical resistor of claim 1, wherein the amorphous alloy comprises $Ni_{81-x}Cr_xB_6Si_{13}$.

3. The electrical resistor of claim 1, wherein the amorphous alloy comprises $Ni_{70}Cr_{11}B_{19-y}Si_y$.

4. The electrical resistor of claim 1, wherein the amorphous alloy comprises $(Ni_{0.864}Cr_{0.136})_{100-z}(B_{0.316}Si_{0.684})_z$.

5. The electrical resistor of claim 2, wherein the amorphous alloy comprises $Ni_{70}Cr_{11}B_6Si_{13}$.

6. The electrical resistor of claim 2, wherein the amorphous alloy comprises $Ni_{64}Cr_{17}B_6Si_{13}$.

7. The electrical resistor of claim 3, wherein the amorphous alloy comprises $Ni_{70}Cr_{11}B_4Si_{15}$.

* * * * *